US009156146B1

(12) United States Patent
Maceo

(10) Patent No.: US 9,156,146 B1
(45) Date of Patent: Oct. 13, 2015

(54) WRENCH ADAPTER DEVICE

(71) Applicant: Keith Maceo, Inglewood, CA (US)

(72) Inventor: Keith Maceo, Inglewood, CA (US)

( * ) Notice: Subject to any disclaimer, the term of this patent is extended or adjusted under 35 U.S.C. 154(b) by 0 days.

(21) Appl. No.: 14/160,983

(22) Filed: Jan. 22, 2014

(51) Int. Cl.
*B25B 13/58* (2006.01)
*B25B 23/00* (2006.01)
*B25B 13/06* (2006.01)

(52) U.S. Cl.
CPC ..... *B25B 23/0007* (2013.01); *B25B 13/06* (2013.01)

(58) Field of Classification Search
CPC ..... B25B 23/00; B25B 13/08; B25B 13/48
USPC ..... 81/180.1, 184, 436, 461, 124.2, 185, 81/124.3, 124.6; 411/2
See application file for complete search history.

(56) References Cited

U.S. PATENT DOCUMENTS

| | | | | | |
|---|---|---|---|---|---|
| 2,486,103 | A | * | 10/1949 | Billeter | 81/479 |
| 4,367,663 | A | * | 1/1983 | Merics | 81/177.2 |
| 4,376,397 | A | * | 3/1983 | Newby et al. | 81/177.2 |
| 4,526,069 | A | | 7/1985 | Cecil | |
| 4,738,167 | A | | 4/1988 | Ball | |
| 5,172,615 | A | * | 12/1992 | Albrecht | 81/436 |
| 5,216,940 | A | | 6/1993 | Hedden | |
| 5,396,820 | A | * | 3/1995 | Baker | 81/177.2 |
| 5,438,894 | A | * | 8/1995 | Pearce | 81/177.2 |
| 5,485,769 | A | * | 1/1996 | Olson et al. | 81/177.85 |
| 5,860,338 | A | * | 1/1999 | Littlefield | 81/177.2 |
| D425,385 | S | | 5/2000 | Jarvis | |
| 6,550,357 | B1 | * | 4/2003 | Freeman | 81/177.2 |
| 6,601,476 | B2 | | 8/2003 | Hu | |
| 7,765,899 | B2 | * | 8/2010 | Nieh | 81/125 |
| 2003/0097911 | A1 | * | 5/2003 | Hu | 81/60 |
| 2004/0089106 | A1 | * | 5/2004 | Wolfe et al. | 81/58.3 |
| 2007/0157772 | A1 | | 7/2007 | Parker | |
| 2008/0041193 | A1 | * | 2/2008 | Baker | 81/124.6 |
| 2009/0078093 | A1 | * | 3/2009 | Suski et al. | 81/121.1 |
| 2012/0060656 | A1 | | 3/2012 | Chang | |

* cited by examiner

*Primary Examiner* — Monica Carter
*Assistant Examiner* — Melanie Alexander

(57) ABSTRACT

A wrench adapter device adapts a conventional box wrench for use with a ratchet. The device includes a housing having a top face, a bottom face, and a perimeter wall coupled to and extending between the top face and the bottom face. The perimeter wall comprising a plurality of planar faces wherein the housing is configured for insertion into a wrench such that the housing is engaged to be rotated by the wrench. A socket extends into the top face of the housing wherein the housing is configured for being engaged by insertion of a drive of a ratchet into the socket.

5 Claims, 2 Drawing Sheets

WRENCH ADAPTER DEVICE

BACKGROUND OF THE DISCLOSURE

Field of the Disclosure

The disclosure relates to connector devices and more particularly pertains to a new connector device for adapting conventional hand wrenches for use with a ratchet or breaker bar.

SUMMARY OF THE DISCLOSURE

An embodiment of the disclosure meets the needs presented above by generally comprising a housing having a top face, a bottom face, and a perimeter wall coupled to and extending between the top face and the bottom face. The perimeter wall comprising a plurality of planar faces wherein the housing is configured for insertion into a wrench such that the housing is engaged to be rotated by the wrench. A socket extends into the top face of the housing wherein the housing is configured for being engaged by insertion of a drive of a ratchet into the socket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
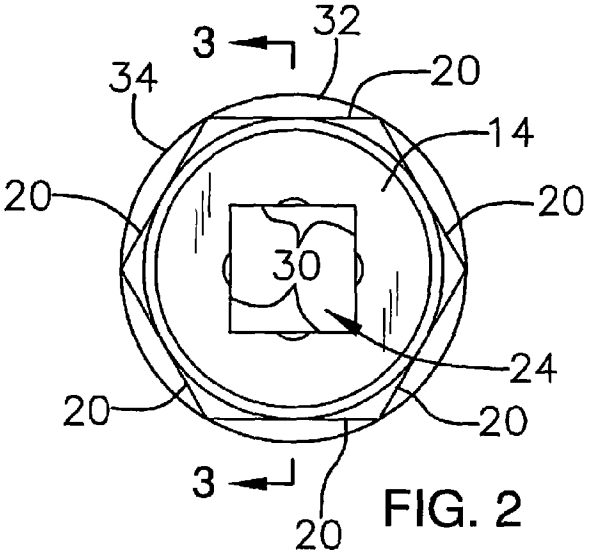
FIG. 2 is a top view of an embodiment of the disclosure.
Figure 3:
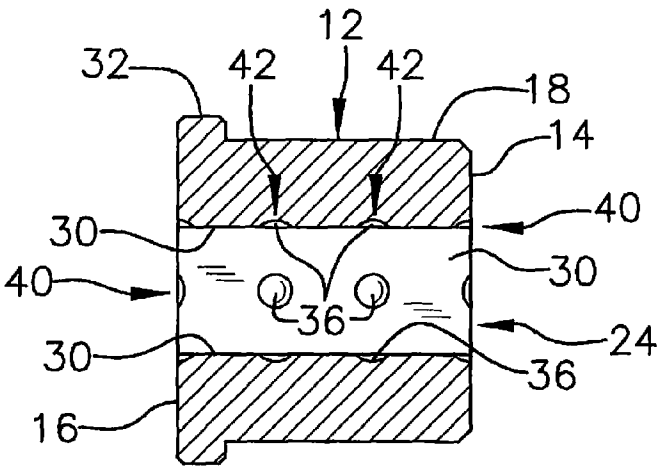
FIG. 3 is a cross-sectional view of an embodiment of the disclosure taken along line 3-3 of FIG. 2.
Figure 1:
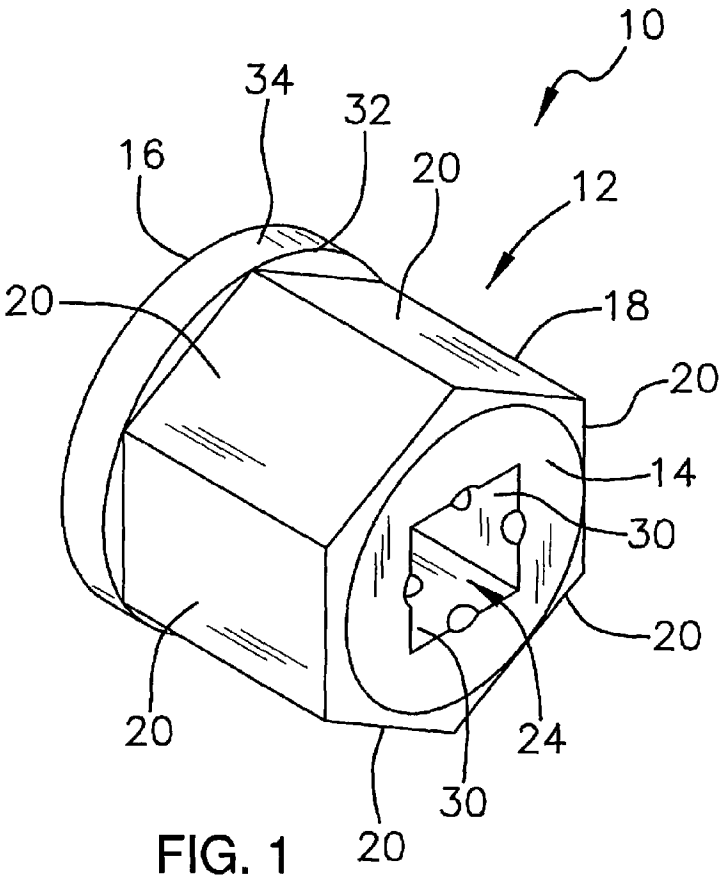
FIG. 1 is a top front side perspective view of a wrench adapter device according to an embodiment of the disclosure.
Figure 4:
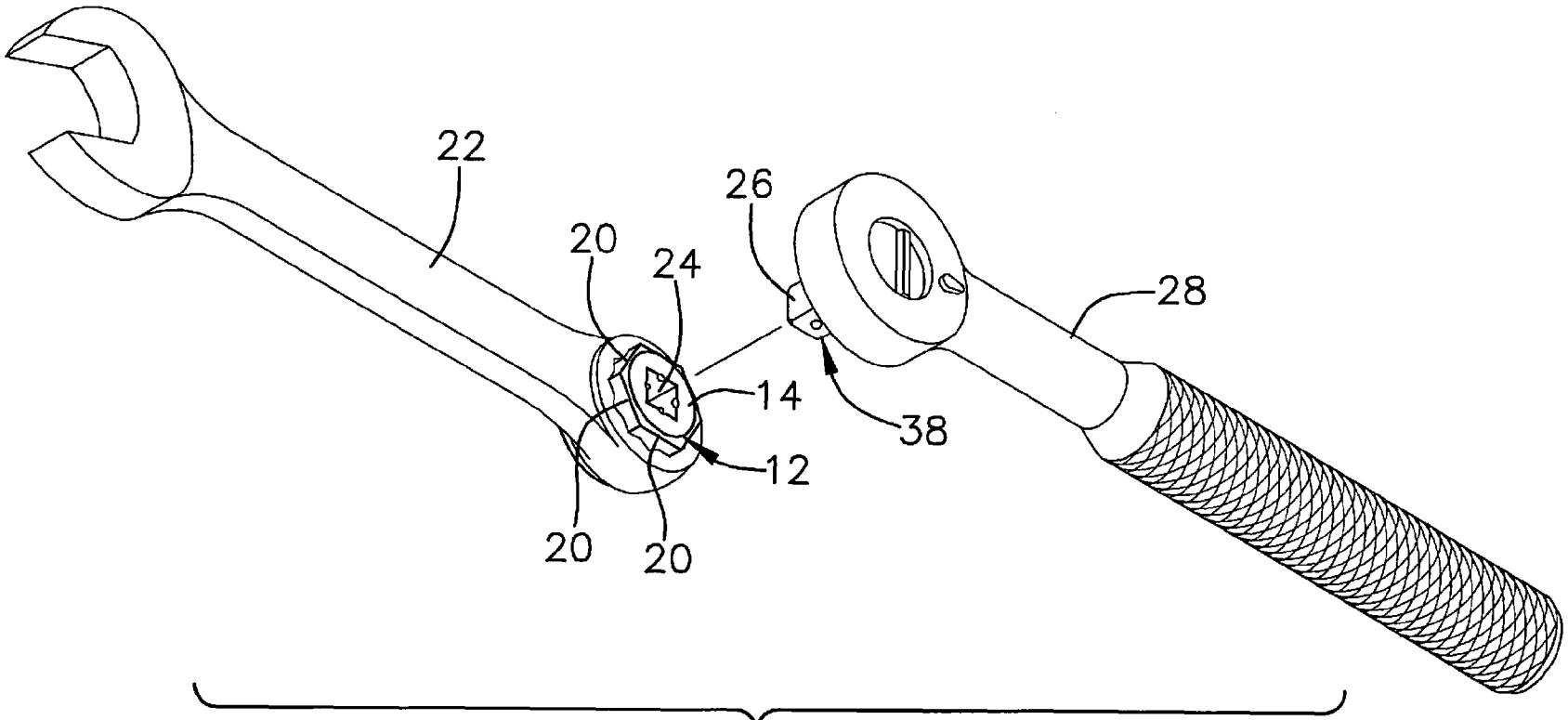
FIG. 4 is a partially exploded top front side perspective view of an embodiment of the disclosure in use.

With reference now to the drawings, and in particular to FIGS. 1 through 4 thereof, a new connector device embodying the principles and concepts of an embodiment of the disclosure and generally designated by the reference numeral 10 will be described.

As best illustrated in FIGS. 1 through 4, the wrench adapter device 10 generally comprises a housing 12 having a top face 14, a bottom face 16, and a perimeter wall 18 coupled to and extending between the top face 14 and the bottom face 16. The perimeter wall 18 may comprise six planar faces 20 wherein the housing 12 is configured for insertion into a wrench 22 wherein the housing 12 is engaged to be rotated by the wrench 22.

A socket 24 extends into the top face 14 of the housing 12 wherein the housing 12 is configured for being engaged by insertion of a drive 26 of a ratchet 28 into the socket 24. The socket 24 is defined by a plurality of planar sides 30 extending into the top face 14 of the housing 12. Each planar side 30 may extend fully through the housing 12 from the top face 14 to the bottom face 16. The socket 24 may be a square drive and may be provided in incremental sizes corresponding to conventional standardized sizes for the drive 26.

A lip 32 extends outwardly from the perimeter wall 18 of the housing 12. The lip 32 is adjacent to the bottom face 16 of the housing 12. The lip 32 may have a circular outer peripheral edge 34. Each of a plurality of indentations 36 extends into an associated one of the planar sides 30 of the socket 24 wherein the socket 24 is configured for being engaged by a spring loaded ball detent mechanism 38 of the drive 26. The indentations 36 are arranged into a plurality of columns 40. Each column 40 is aligned at a center of a respective one of the planar sides 30 of the socket 24. The indentations 36 are further arranged into a plurality of spaced planar rows 42 with each row 42 extending around the socket 24 with one respective indentation 36 on each planar side 30.

In use, the device 10 is inserted through the wrench 22 and coupled to the drive 26 of the ratchet 28 by insertion of the drive 26 into the socket 24. The wrench 22, when of a closed type, is secured to the device 10 between the lip 32 and the ratchet 28 permitting engagement of a second end of the wrench 22 to a screw, nut, or the like to be rotated with the wrench 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wrench adapter device comprising:

a wrench having a closed end and an open second end;

a housing having a top face, a bottom face, and a perimeter wall coupled to and extending between said top face and said bottom face, said perimeter wall comprising a plurality of planar faces wherein said housing is configured for insertion into said closed end of said wrench wherein said housing is engaged to be rotated by said wrench;

a lip extending outwardly from said perimeter wall of said housing, said lip being adjacent to said bottom face of said housing;

a socket extending into said top face of said housing, said socket being defined by a plurality of planar sides extending into said top face of said housing;

a drive of a ratchet being insertable into said socket wherein said wrench is coupled to said housing between said ratchet and said lip and said wrench is operable by manipulation of said ratchet; and a plurality of indentations, each indentation extending into an associated one of said planar sides of said socket wherein said socket is configured for being engaged by a spring loaded ball detent mechanism of the drive, said indentations being arranged into a plurality of columns, each column being aligned at a center of a respective one of said planar sides of said socket, said indentations being arranged into a plurality of spaced planar rows, each row extending around said socket, each said column having a pair of outer indentations, each of said outer indentations being positioned along a respective edge of said respective one of said planar side of said socket such that each of said outer indentations extends into said socket from a respective one of said top face and said bottom face of said housing.

2. The device of claim 1, further comprising said perimeter wall comprising six planar faces.

3. The device of claim 1, further comprising each said planar side extending fully through said housing from said tip face to said bottom face.

4. The device of claim 1, further comprising said lip having a circular outer peripheral edge.

5. A wrench adapter device comprising:

a wrench having a closed end and an open second end;

a housing having a top face, a bottom face, and a perimeter wall coupled to and extending between said top face and said bottom face, said perimeter wall comprising a six planar faces wherein said housing is configured for insertion into said closed end of said wrench wherein said housing is engaged to be rotated by said wrench;

a lip extending outwardly from said perimeter wall of said housing, said lip being adjacent to said bottom face of said housing;

a socket extending into said top face of said housing;

a drive of a ratchet being insertable into said socket wherein said wrench is coupled to said housing between said ratchet and said lip and said wrench is operable by manipulation of said ratchet, said socket being defined by a plurality of planar sides extending into said top face of said housing, each said planar side extending fully through said housing from said top face to said bottom face; and a plurality of indentations, each indentation extending into an associated one of said planar sides of said socket wherein said socket is configured for being engaged by a spring loaded ball detent mechanism of the drive, said indentations being arranged into a plurality of columns, each column being aligned at a center of a respective one of said planar sides of said socket, said indentations being arranged into a plurality of spaced planar rows, each row extending around said socket, each said column having a pair of outer indentations, each of said outer indentations being positioned along a respective edge of said respective one of said planar side of said socket such that each of said outer indentations extends into said socket from a respective one of said top face and said bottom face of said housing.

* * * * *